US005463188A

United States Patent [19]

Nohmi et al.

[11] Patent Number: 5,463,188

[45] Date of Patent: Oct. 31, 1995

[54] COAXIAL CABLE

[75] Inventors: Yasuhiro Nohmi, Tokyo; Tadashi Yamaguchi, Nagano; Kimio Matsuzawa, Nagano; Naoki Katagiri, Nagano; Hotaka Sakaguchi, Nagano, all of Japan

[73] Assignee: NEC Corporation, Tokyo, Japan

[21] Appl. No.: 251,044

[22] Filed: May 31, 1994

[30] Foreign Application Priority Data

Jun. 4, 1993 [JP] Japan ..... 5-134886

[51] Int. Cl.[6] ..... H01B 7/34

[52] U.S. Cl. ..... 174/108; 174/36; 174/102 R; 174/106 R

[58] Field of Search ..... 174/36, 102 R, 174/106 R, 108

[56] References Cited

U.S. PATENT DOCUMENTS 4,408,089 10/1983 Nixon ..... 174/34
4,642,417 2/1987 Ruthrof et al. ..... 174/36
4,979,795 12/1990 Mascarenhas ..... 174/108
5,304,739 4/1994 Klug et al. ..... 174/102 R

FOREIGN PATENT DOCUMENTS 51-2280 1/1976 Japan .
6076641 3/1994 Japan ..... 174/36

*Primary Examiner*—Morris H. Nimmo
*Attorney, Agent, or Firm*—Whitham, Curtis, Whitham & McGinn

[57] ABSTRACT

The coaxial cable of the present invention is an insulating layer, an outer conducting layer and a protective film layer formed in that order around a center conductor, the outer conducting layer being formed from a primary transverse winding and a secondary transverse winding, each of a plurality of thin metal wires, the winding directions of the transverse windings being opposite each other. The winding angle of the primary and secondary transverse windings with respect to the center conductor is 30°±5° and the winding pitches of the primary and secondary transverse windings are from 0.8 to 2.0 times the bending radius of the coaxial cable.

5 Claims, 1 Drawing Sheet

COAXIAL CABLE

BACKGROUND OF THE INVENTION

1. Field of the Invention

The present invention relates to a coaxial cable, and in particular to coaxial cable useful as thin coaxial cable for high-frequency use that can be used in a twisting and bending portion of mobile communication equipment.

2. Description of the Related Art

As an example of coaxial cable of the prior art, Japanese U.M. Laid-open No. 2280/76 is known. In this coaxial cable, an insulating layer, an outer conducting layer and a protective film layer are formed in that order around a center conductor, the outer conducting layer being formed from a primary transverse winding and a secondary transverse winding of a plurality of thin metal wires, the winding directions of the primary transverse winding and the secondary transverse winding being in opposite directions. While not disclosed in Japanese U.M. Laid-open No. 2280/76, the winding angle has conventionally been from 10° to 20° with respect to the center conductor out of consideration of productivity.

The above-described coaxial cable of the prior art has good high-frequency transmission characteristics, but is subject to frequent wire breakage when used in the twisting and bending portion of a portable telephone or other equipment.

SUMMARY OF THE INVENTION

The object of the present invention is to provide a coaxial cable having excellent high-frequency transmission characteristics that furthermore resists wire breakage even when used in a twisting and bending portion of a portable telephone or other equipment.

The above-described object can be achieved by a coaxial cable according to the present invention in which an insulating layer, an outer conducting layer and a protective film layer are formed in that order around a center conductor, the outer conducting layer being formed from a primary transverse winding and a secondary transverse winding, each of a plurality of thin metal wires, the winding directions of the two windings being in opposite directions, the winding angle of the primary transverse winding and the secondary transverse winding being 30°±5° with respect to the center conductor, and the winding pitch of the primary transverse winding and the secondary transverse winding being from 0.8 to 2.0 times the bending radius.

In the coaxial cable of the present invention, the winding angle of the primary transverse winding and the secondary transverse winding is 30°±5° with respect to the center conductor, and within this range, the winding pitch of the primary transverse winding and the secondary transverse winding is from 0.8 to 2.0 times the bending radius. This winding pitch is small compared to the winding pitch of the prior art, but as shown by research findings, maintains unchanged the good high-frequency transmission characteristics and prevents wire breakage to a greater degree than the prior art.

In one embodiment of the present invention, the bending radius is greater than 2 mm and less than 10 mm, and accordingly, the coaxial cable of the present invention is well suited for use in the twisting and bending portion of a portable telephone or other equipment.

In another embodiment of the present invention, a lubricant is applied to the thin metal wires of the outer conducting layer. It was found that as a result, because the thin metal wires of the outer conducting layer can easily slide, external forces against the thin metal wires of the outer conducting layer can be readily dispersed, thereby providing additional protection against wire breakage.

The above and other objects, features, and advantages of the present invention will become apparent from the following description based on the accompanying drawings which illustrate an example of a preferred embodiment of the present invention.

DETAILED DESCRIPTION OF THE PREFERRED EMBODIMENTS

Figure 1:
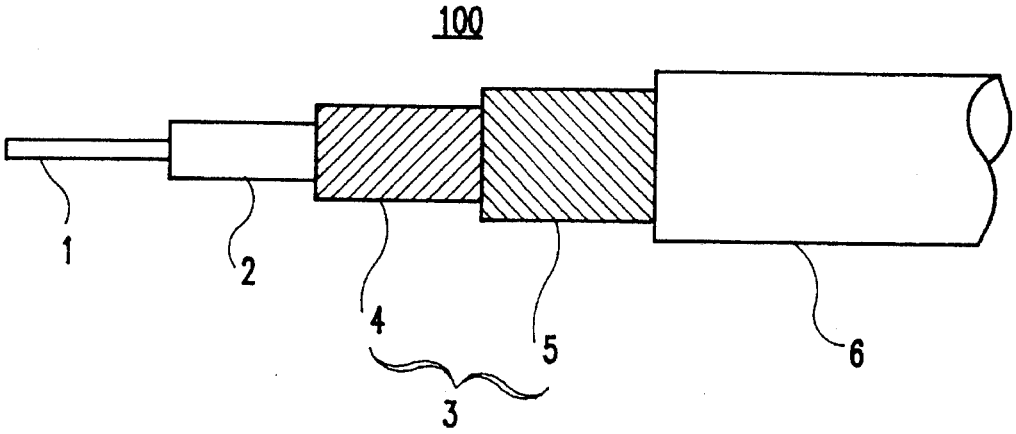
FIG. 1 shows the construction of a first embodiment of the coaxial cable of the present invention.

With reference to FIG. 1, the coaxial cable 100 of the present invention has a construction in which an insulating layer 2, an outer conducting layer 3 and a protective film layer 6 are formed in that order around a center conductor 1.

The outer conducting layer 3 is formed from a primary transverse winding 4 and a secondary transverse winding 5, each of a plurality of thin metal wires, the winding direction of the two transverse windings being in opposite directions.

Furthermore, the winding angle θ of the primary transverse winding 4 and the secondary transverse winding 5 is 30°±5° with respect to the center conductor 1, and moreover, the winding pitch P is from 0.8 to 2.0 times the bending radius r.

In addition, in view of ease of manufacture and the balance of high-frequency and bending characteristics, the winding density K is preferably from 90% to 96%.

Here, the winding angle θ can be expressed by $$\sin\theta = n \cdot d/(K \cdot P)$$

where n is the number of individual wires and d is the diameter of each wire.

The winding pitch P can be expressed by $$\begin{aligned} P &= n \cdot d/\sqrt{[K^2 - \{n \cdot d/(\pi \cdot D)\}^2]} \\ &= n \cdot d/(K \cdot \sin\theta) \end{aligned}$$

where D is the average diameter of the transverse winding.

Figure 2:
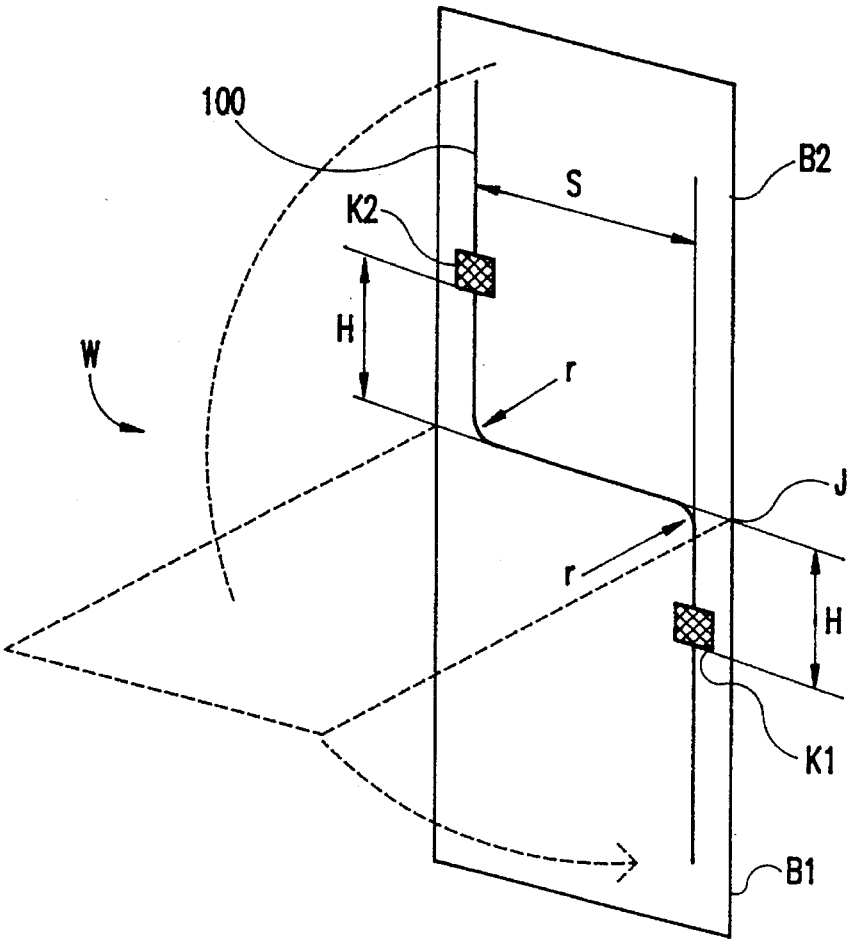
FIG. 2 is a perspective view of an apparatus for testing twisting and bending of a coaxial cable.

Further, the bending radius r refers to the radius r of the arc portion when the coaxial cable 100 is bent as shown in FIG. 2.

Considered from the standpoint of use in equipment such as portable telephones, the bending radius r preferably ranges from 2 mm to 10 mm.

Considered from the standpoint of use in equipment such as portable telephones, the outer diameter of the protective film layer 6, i.e., the outer diameter of the finished cable, is preferably equal to or less than 2 mm.

Further, application of a lubricant such as fluid paraffin or silicone oil to the thin metal wires of the outer conducting layer 3 allows increased protection against wire breakage.

FIG. 2 illustrates an apparatus for testing twisting and bending of a coaxial cable 100. This twisting-bending test apparatus W comprises plates B1, B2, each provided with attachments K1, K2 for securing a coaxial cable 100, which are linked at axis J so as to be capable of opening and closing.

As shown in FIG. 2, a 200-mm length of coaxial cable 100 is secured in this twisting-bending test apparatus W. At the time of securing, length H from the axis J to attachments K1 and K2 is 15 mm, the length of span S is 20 mm, and the bending radius r changes as appropriate.

Plates B1 and B2 are repeatedly opened and closed from an angle of 0° to an angle of 180° and wire breakage in the outer conducting layer 3 is investigated.

Herein below are presented manufactured examples and comparative examples of coaxial cable 100 designed for a bending radius of r=4 mm.

MANUFACTURED EXAMPLE 1

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (fluorinated ethylene propylene resin or FEP), which has excellent electrical characteristics, extruded onto the outside of the center conductor 1 to a thickness of 0.22 mm, resulting in an outer diameter of 0.70 mm. The primary transverse winding 4 was 25 silver-plated annealed copper wires, each wire having a diameter d=0.08 mm, wound around the outside of the insulating layer 2 in a parallel state and in a leftward direction at a winding angle θ=28.6°, a winding pitch P=4.5 mm (the ratio to the bending radius r=4 mm being 1.125), resulting in an outer diameter of 0.86 mm. The secondary transverse winding 5 was 30 silver-plated annealed copper wires, each wire having a diameter d=0.08 mm, wound around the outside of the primary transverse winding 4 in a parallel state and in a rightward direction at a winding angle θ=27.4°, a winding pitch P=5.7 mm (the ratio to the bending radius r=4 mm being 1.425), resulting in an outer diameter of 1.02 mm. The protective film layer 6 was a copolymer resin of tetrafluoroethylene-ethylene (ethylene tetrafluoroethylene resin or ETFE), which has good mechanical strength, heat resistance and sliding characteristics, extruded around the secondary transverse winding 5 at a thickness of 0.19 mm, resulting in an outer diameter of 1.40 mm.

After bending the cable 80,000 times in the twisting-bending test, 4 broken wires were found in the primary transverse winding 4 and 2 broken wires were found in the secondary transverse winding 5. High-frequency characteristics were good both before and after the twisting-bending test.

MANUFACTURED EXAMPLE 2

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (FEP), which has excellent electrical characteristics, extruded onto the outside of the center conductor 1 to a thickness of 0.22 mm, resulting in an outer diameter of 0.70 mm. The primary transverse winding 4 was 25 silver-plated annealed copper wires applied with fluid paraffin, each wire having a diameter d=0.08 mm, wound around the outside of the insulating layer 2 in a parallel state and in a leftward direction at a winding angle θ=28.6°, a winding pitch P=4.5 mm (the ratio to the bending radius r=4 mm being 1.125), resulting in an outer diameter of 0.86 mm. The secondary transverse winding 5 was 30 silver-plated annealed copper wires applied with fluid paraffin, each wire having a diameter d=0.08 mm, wound around the outside of the primary transverse winding 4 in a parallel state and in a rightward direction at a winding angle θ=27.4°, a winding pitch P=5.7 mm (the ratio to the bending radius r=4 mm being 1.425), resulting in an outer diameter of 1.02 mm. The protective film layer 6 was a copolymer resin of tetrafluoroethylene-ethylene (ETFE) extruded around the secondary transverse winding 5 at a thickness of 0.19 mm, resulting in an outer diameter of 1.40 mm.

After bending the cable 80,000 times in the twisting-bending test, no broken wires were found in either the primary transverse winding 4 or in the secondary transverse winding 5. High-frequency characteristics were good both before and after the twisting-bending test.

MANUFACTURED EXAMPLE 3

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (FEP), which has excellent electrical characteristics, extruded onto the outside of the center conductor 1 to a thickness of 0.22 mm, resulting in an outer diameter of 0.70 mm. The primary transverse winding 4 was 26 silver-plated annealed copper wires, each wire having a diameter d=0.08 mm, wound around the outside of the insulating layer 2 in a parallel state and in a leftward direction at a winding angle θ=25.2°, a winding pitch P=5.2 mm (the ratio to the bending radius r=4 mm being 1.300), resulting in an outer diameter of 0.86 mm. The secondary transverse winding 5 was 31 silver-plated annealed copper wires, each wire having a diameter d=0.08 mm, wound around the outside of the primary transverse winding 4 in a parallel state and in a rightward direction at a winding angle θ=25.1°, a winding pitch P=6.3 mm (the ratio to the bending radius r=4 mm being 1.075), resulting in an outer diameter of 1.02 mm. The protective film layer 6 was a copolymer resin of tetrafluoroethylene-ethylene (ETFE) extruded around the secondary transverse winding 5 at a thickness of 0.19 mm, resulting in an outer diameter of 1.40 mm.

After bending the cable 80,000 times in the twisting-bending test, 6 broken wires were found in the primary transverse winding 4 and 10 broken wires were found in the secondary transverse winding 5. High-frequency characteristics were good both before and after the twisting-bending test.

COMPARATIVE EXAMPLE 1

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (FEP), which has excellent electrical characteristics, extruded onto the outside of the center conductor 1 to a thickness of 0.22 mm, resulting in an outer diameter of 0.70 mm. The primary transverse winding 4 was 22 silver-plated annealed copper wires, each wire having a diameter d=0.08 mm, wound around the outside of the insulating layer 2 in a parallel state and in a leftward direction at a winding angle θ=38.3°, a winding pitch P=3.1 mm (the ratio to the bending radius r=4 mm being 0.775), resulting in an outer diameter of 0.86 mm. The secondary transverse winding 5 was 28 silver-plated annealed copper wires, each wire having a diameter d=0.08 mm, wound around the outside of the primary transverse winding 4 in a parallel state and in a rightward direction at a winding angle θ=33.3°, a winding pitch P=4.5 mm (the ratio to the bending radius r=4 mm being 1.125), resulting in an outer diameter of 1.02 mm. The protective film layer 6 was a copolymer resin of tetrafluoroethylene-ethylene (ETFE) extruded around the secondary transverse winding 5 at a thickness of 0.19 mm, resulting in an outer diameter of 1.40 mm.

After bending the cable 80,000 times in the twisting-bending test, 18 broken wires were found in the primary transverse winding 4 and 6 broken wires were found in the secondary transverse winding 5. In other words, broken wires were especially numerous in the primary transverse winding 4. A deterioration in the shielding characteristics was noted over the course of the twisting-bending test.

COMPARATIVE EXAMPLE 2

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (FEP), which has excellent electrical characteristics, extruded onto the outside of the center conductor 1 to a thickness of 0.22 mm, resulting in an outer diameter of 0.70 mm. The primary transverse winding 4 was 27 silver-plated annealed copper wires, each wire having a diameter d=0.08 mm, wound around the outside of the insulating layer 2 in a parallel state and in a leftward direction at a winding angle θ=17.0°, a winding pitch P=8.0 mm (the ratio to the bending radius r=4 mm being 2.000), resulting in an outer diameter of 0.86 mm. The secondary transverse winding 5 was 33 silver-plated annealed copper wires, each wire having a diameter d=0.08 mm, wound around the outside of the primary transverse winding 4 in a parallel state and in a rightward direction at a winding angle θ=15.3°, a winding pitch P=10.0 mm (the ratio to the bending radius r=4?mm being 2.500), resulting in an outer diameter of 1.02 mm. The protective film layer 6 was a copolymer resin of tetrafluoroethylene-ethylene (ETFE) extruded around the secondary transverse winding 5 at a thickness of 0.19 mm, resulting in an outer diameter of 1.40 mm.

After bending the cable 80,000 times in the twisting-bending test, 12 broken wires were found in the primary transverse winding 4 and all of the wires were broken in the secondary transverse winding 5. A deterioration in the shielding characteristics was noted over the course of the twisting-bending test.

COMPARATIVE EXAMPLE 3

The center conductor 1 was 19 silver-plated copper alloy wires 0.05 mm in diameter gathered and twisted together and had an outer diameter of 0.25 mm. The insulating layer 2 was a copolymer resin of tetrafluoroethylene and hexafluoropropylene (FEP), which has excellent electrical characteristics, extruded onto the outside of the center conductor 1 to a thickness of 0.22 mm, resulting in an outer diameter of 0.70 mm. The outer conducting layer 3 was braided wire braided from eight strands of five silver-plated annealed copper wires, each wire having a diameter of 0.08 mm. The pitch was 5.0 mm, resulting in an outer diameter of 1.10 mm. The protective film layer 6 was a copolymer resin of tetrafluoroethylene-ethylene (ETFE) extruded around the secondary transverse winding 5 at a thickness of 0.19 mm, resulting in an outer diameter of 1.48

After bending the cable 50,000 times in the twisting-bending test, all of the wires in the outer conducting layer 3 were broken. A deterioration in the shielding characteristics was noted over the course of the twisting-bending test.

While a preferred embodiment of the invention has been described using specific terms, such description is for illustrative purposes only, and it is to be understood that changes and variations may be made without departing from the spirit or the scope of the following claims.

What is claimed is:

1. A coaxial cable wherein an insulating layer, an outer conducting layer and a protective film layer are formed in that order around a center conductor, the outer conducting layer being formed from a primary transverse winding and a secondary transverse winding each of a plurality of thin metal wires, the winding directions of the two transverse windings being opposite each other, the winding angles of the primary transverse winding and secondary transverse winding being 30°±5° with respect to the center conductor, and the winding pitches of the primary transverse winding and secondary transverse winding being from 0.8 to 2.0 times a bending radius of the coaxial cable.

2. The coaxial cable according to claim 1 wherein the bending radius is greater or equal to 2 mm and less than or equal to 10 mm.

3. The coaxial cable according to claim 1 wherein the finished outer diameter is 2.0 mm or less.

4. The coaxial cable according to claim 1 wherein a lubricant is applied to the plurality of thin metal wires of the outer conducting layer.

5. The coaxial cable according to claim 1 wherein the protective film layer is formed from ethylene-tetrafluoroethylene copolymer resin.

* * * * *